US006572212B2

(12) United States Patent
Konno et al.

(10) Patent No.: US 6,572,212 B2
(45) Date of Patent: Jun. 3, 2003

(54) INK-JET PRINTER AND CONTROL METHOD AND APPARATUS FOR THE SAME

(75) Inventors: Yuji Konno, Kanagawa (JP); Miyuki Fujita, Tokyo (JP); Shuichi Murakami, Kanagawa (JP); Michinari Mizutani, Kanagawa (JP); Norihiro Kawatoko, Kanagawa (JP); Takayuki Ogasahara, Kanagawa (JP); Tetsuya Edamura, Kanagawa (JP); Tetsuhiro Maeda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/902,596

(22) Filed: Jul. 12, 2001

(65) Prior Publication Data

US 2002/0018091 A1 Feb. 14, 2002

(30) Foreign Application Priority Data

Jul. 17, 2000 (JP) ..... 2000-216264

(51) Int. Cl.[7] ..... B41J 29/393; B41J 29/38

(52) U.S. Cl. ..... 347/19; 347/14

(58) Field of Search ..... 347/19, 43, 49, 347/14, 86, 23, 12, 10, 85, 30, 7; 400/175, 705

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/56 |
| 4,723,129 A | | 2/1988 | Endo et al. | 347/56 |
| 4,740,796 A | | 4/1988 | Endo et al. | 347/56 |
| 5,946,006 A | | 8/1999 | Tajika et al. | 347/19 |
| 6,151,041 A | * | 11/2000 | Bolash et al. | 347/19 |
| 6,361,138 B1 | * | 3/2002 | Seino et al. | 347/19 |

FOREIGN PATENT DOCUMENTS

| | | | |
|---|---|---|---|
| EP | 0 645 246 | 3/1995 | |
| EP | 0 670 219 | 9/1995 | |
| JP | 54-161935 | 12/1974 | |
| JP | 59-123670 | 7/1984 | 347/65 |
| JP | 59-138461 | 8/1984 | |
| JP | 61-185455 | 8/1986 | |
| JP | 61-249768 | 11/1986 | |
| JP | 2-167755 | 6/1990 | |
| JP | 4-10941 | 1/1992 | |

* cited by examiner

*Primary Examiner*—Lamson Nguyen
*Assistant Examiner*—Charles W. Stewart, Jr.
(74) *Attorney, Agent, or Firm*—Fitzpatrick, Cella, Harper & Scinto

(57) ABSTRACT

This invention relates to an ink-jet printer equipped with an ink-jet printhead and a control method and apparatus for the ink-jet printer. The printhead incorporates an EEPROM storing head information including the ink discharge amount characteristics of the printhead. The head information stored in this EEPROM is transmitted from the ink-jet printer having the printhead to the printer driver of a host computer. The printer driver then selects a gamma correction table in accordance with the head information. In this case, a gamma correction table is selected from a plurality of gamma correction tables in which pieces of correction information which make print densities uniform are stored in correspondence with ink discharge amounts. This table also includes correction data for correcting an increase in ink discharge amount to prevent beading due to an increase in ink discharge amount with a rise in the temperature of the printhead.

16 Claims, 16 Drawing Sheets

FIG. 6

| DISCHARGE AMOUNT RANK | NORMAL DISCHARGE AMOUNT (ng) | CONVERSION DISCHARGE AMOUNT AFTER DISCHARGE AMOUNT CORRECTION (ng) | DISCHARGE AMOUNT IN PROCESS OF TEMPERATURE RISE (ng) | OCCURRENCE OF BEADING |
|---|---|---|---|---|
| DOUBLE SMALL | 3.8～4.0 | 3.8～4.0 | 4.8～5.0 | ○ |
| SMALL | 4.0～4.3 | 3.9～4.2 | 4.9～5.2 | ○ |
| INTERMEDIATE | 4.3～4.7 | 4.1～4.5 | 5.1～5.5 | ○ |
| LARGE | 4.7～5.0 | 4.4～4.7 | 5.4～5.7 | △ |
| DOUBLE LARGE | 5.0～5.2 | 4.6～4.8 | 5.6～5.8 | × |

BEADING OCCURRENCE CONVERSION DISCHARGE AMOUNT OF 5.5ng

FIG. 8

| DISCHARGE AMOUNT RANK | NORMAL DISCHARGE AMOUNT (ng) | CONVERSION DISCHARGE AMOUNT AFTER DISCHARGE AMOUNT CORRECTION (ng) | DISCHARGE AMOUNT IN PROCESS OF TEMPERATURE RISE (ng) | OCCURRENCE OF BEADING |
|---|---|---|---|---|
| DOUBLE SMALL | 3.8～4.0 | 3.8～4.0 | 4.8～5.0 | ○ |
| SMALL | 4.0～4.3 | 3.9～4.2 | 4.9～5.2 | ○ |
| INTERMEDIATE | 4.3～4.7 | 4.1～4.5 | 5.1～5.5 | ○ |
| LARGE | 4.7～5.0 | 4.2～4.5 | 5.2～5.5 | ○ |
| DOUBLE LARGE | 5.0～5.2 | 4.3～4.5 | 5.3～5.5 | ○ |

BEADING OCCURRENCE CONVERSION DISCHARGE AMOUNT OF 5.5ng

FIG. 11

| DISCHARGE AMOUNT RANK INFORMATION | RANK VALUE | CONVERSION DISCHARGE AMOUNT CORRECTION RANGE(ng) | ACTUAL DISCHARGE AMOUNT RANK | NORMAL DISCHARGE AMOUNT(ng) | CONVERSION DISCHARGE AMOUNT AFTER DISCHARGE AMOUNT CORRECTION | DISCHARGE AMOUNT IN PROCESS OF TEMPERATURE RISE (ng) |
|---|---|---|---|---|---|---|
| DOUBLE SMALL | −2 | 0 | DOUBLE SMALL | 3.8~4.0 | 3.8~4.0 | 4.8~5.0 |
| SMALL | −1 | −0.1 | SMALL | 4.0~4.3 | 3.9~4.2 | 4.9~5.2 |
| INTERMEDIATE | 0 | −0.2 | INTERMEDIATE | 4.3~4.7 | 4.1~4.5 | 5.1~5.5 |
| LARGE | 1 | −0.3 | | | | |
| DOUBLE LARGE | 2 | −0.4 | | | | |
| TRIPLE LARGE | 3 | −0.5 | LARGE | 4.7~5.0 | 4.2~4.5 | 5.2~5.5 |
| QUADRUPLE LARGE | 4 | −0.6 | | | | |
| QUINTET LARGE | 5 | −0.7 | DOUBLE LARGE | 5.0~5.2 | 4.3~4.5 | 5.3~5.5 |

FIG. 12

| INK CHANNEL HEIGHT | INCREASE IN DISCHARGE AMOUNT WITH TEMPERATURE RISE |
|---|---|
| 13 μm | 0.5ng |
| 15 μm | 1.0ng |
| 17 μm | 1.5ng |

FIG. 14A

FOR DISCHARGE AMOUNT CORRECTION OF HEAD WITH INK CHANNEL HEIGHT OF 13 μm

| DISCHARGE AMOUNT RANK | NORMAL DISCHARGE AMOUNT(ng) | CONVERSION DISCHARGE AMOUNT CORRECTION RANGE (ng) | CONVERSION DISCHARGE AMOUNT AFTER DISCHARGE AMOUNT CORRECTION(ng) | DISCHARGE AMOUNT IN PROCESS OF TEMPERATURE RISE (ng) |
|---|---|---|---|---|
| DOUBLE SMALL | 3.8~4.0 | 0 | 3.8~4.0 | 4.3~4.5 |
| SMALL | 4.0~4.3 | −0.1 | 3.9~4.2 | 4.4~4.7 |
| INTERMEDIATE | 4.3~4.7 | −0.2 | 4.1~4.5 | 4.6~5.0 |
| LARGE | 4.7~5.0 | −0.3 | 4.4~4.7 | 4.9~5.2 |
| DOUBLE LARGE | 5.0~5.2 | −0.4 | 4.6~4.8 | 5.1~5.3 |

FIG. 14B

FOR DISCHARGE AMOUNT CORRECTION OF HEAD WITH INK CHANNEL HEIGHT OF 17 μm

| DISCHARGE AMOUNT RANK | NORMAL DISCHARGE AMOUNT(ng) | CONVERSION DISCHARGE AMOUNT CORRECTION RANGE (ng) | CONVERSION DISCHARGE AMOUNT AFTER DISCHARGE AMOUNT CORRECTION(ng) | DISCHARGE AMOUNT IN PROCESS OF TEMPERATURE RISE (ng) |
|---|---|---|---|---|
| DOUBLE SMALL | 3.8~4.0 | 0 | 3.8~4.0 | 5.3~5.5 |
| SMALL | 4.0~4.3 | −0.3 | 3.7~4.0 | 5.2~5.5 |
| INTERMEDIATE | 4.3~4.7 | −0.7 | 3.6~4.0 | 5.1~5.5 |
| LARGE | 4.7~5.0 | −1.0 | 3.7~4.0 | 5.2~5.5 |
| DOUBLE LARGE | 5.0~5.2 | −1.2 | 3.8~4.0 | 5.3~5.5 |

INK-JET PRINTER AND CONTROL METHOD AND APPARATUS FOR THE SAME

FIELD OF THE INVENTION

The present invention relates to an ink-jet printer for printing an image on a printing medium by discharging ink from an ink-jet printhead onto the printing medium and a control method and apparatus for the ink-jet printer.

BACKGROUND OF THE INVENTION

In general, an ink-jet printer capable of outputting color images has a plurality of printheads for discharging inks of four colors, i.e., yellow, cyan, magenta, and black (to be respectively referred to as Y, M, C, and K hereinafter). Recently, an arrangement for printing color images by using six or more inks including light inks obtained by decreasing the densities of color inks (e.g., light cyan and light magenta (to be respectively referred to as LC and LM hereinafter) inks obtained by decreasing the densities of cyan and magenta inks) and inks having normal densities is often used to suppress the graininess of dots in a highlight portion.

A printhead used for an ink-jet printer will be described next.

Ink-jet printing schemes include a scheme using an electrothermal transducer (heater) as an element for generating discharge energy to discharge ink droplets and a scheme using a piezoelectric element. In both schemes, ink is discharged by supplying an electrical signal to an element for generating discharge energy. An advantage of the former scheme is that only a small space is required to place each heater serving as an element for generating discharge energy. This makes it possible to simplify the arrangement of an ink-jet printhead and hence reduce its size. In addition, it is relatively easy to achieve an increase in density.

A disadvantage of this scheme is that the heat generated by each heater is accumulated in the printhead. As a consequence, discharged ink droplets tend to vary in volume. In addition, shock (cavitation) is produced when air bubbles generated to discharge ink shrink and disappear to greatly affect the heaters.

As methods of solving these problems, for example, ink-jet printing methods and ink-jet printheads are disclosed in Japanese Patent Laid-Open Nos. 54-161935, 61-185455, 61-249768, and 4-10941. According to these methods and printheads, each ink-jet head has orifices for discharging a liquid, ink channels, each of which communicates with the orifice and is filled with ink, and an electrothermal transducer placed in each ink channel. This electrothermal transducer is generally formed by a thin resistive element. According to a characteristic feature of this electrothermal transducer, a pulse-like current is supplied (application of a driving pulse) to the electrothermal transducer through an interconnection to generate heat energy. By using such a printing method, the stability of the volume of each ink droplet can be improved, and small droplets can be discharged at high speed. This makes it possible to improve the durability of each heater by solving the problem caused by cavitations produced by printing and defoaming of ink.

A plurality of printheads are used to print images in the above four colors, Y, M, C and K, or six colors, Y, M, C, K, LC and LM. Such printheads are mass-produced. The ink discharge amounts of the respective printheads vary due to manufacturing variations in characteristics of the respective printheads. These variations roughly amount to, e.g., ±10% with respect to a standard discharge amount. Since the ink discharge amounts of the respective printheads vary in this manner, printed images differ in their density and color appearance.

In general, a printer is designed such that the tone of an output image is determined on the premise that each printhead has a standard ink discharge amount. For this reason, the image printed by using an ink-jet printer using a printhead whose ink discharge amount deviates from the standard discharge amount differs in tone from the designed color image. With an improvement in image quality in recent ink-jet printers, an image with photo quality can be obtained. For a photographic image, its color tone is an important factor that determines its image quality. If, therefore, the tone deviates from the designed value for the above reason, the following problems arise:

(a) The color reproducibility deteriorates.

(b) Tone skip occurs (due to an imbalance between normal ink and light ink of the same color, in particular), and the tone continuity deteriorates.

(c) False contours are produced.

These problems may greatly impair the image quality.

For this reason, a method is disclosed in Japanese Patent Laid-Open No. 2-167755, in which γ correction tables used for γ (gamma) correction in an image processing unit are prepared for the respective ink discharge amount characteristics of printheads, and the ink discharge amount characteristic information written in the printhead mounted in an ink-jet printer is read out to select a γ correction table corresponding to the discharge amount information, thereby performing image processing for the corresponding image data. With the use of such a method, even if the ink discharge amounts of printheads vary, changes in the density and color appearance of images can be minimized.

A characteristic feature of the above conventional printhead is that it has excellent ink droplet discharge stability. If, however, the driving frequency of the printhead increases and printing operation is continuously performed, or an image with a high duty is printed, the temperature of the printhead rises, resulting in variations in the ink discharge amount of the printhead. The variations reach about 15 to 20% due to a rise in temperature. This is because, an air bubble generated by the heater considerably grows with a rise in temperature, and consequently, the remaining ink in the nozzle liquid chamber decreases at the time of ink discharging operation, resulting in an increase in the amount of ink droplet discharged at once. The adverse effects caused by such an increase in ink discharge amount include an increase in graininess due to an increase in dot diameter, a change in print density, and beading (ink soaking and smear due to ink soaking) caused when the amount of ink supplied to a printing media exceeds its ink absorbing (receiving) capacity. Of these adverse effects, beading is especially serious. The occurrence of such beading causes information loss in a high-density portion of an image, or considerably degrades a sense of resolution, resulting in serious problems.

According to Japanese Patent Laid-Open No. 2-167755 that discloses the method of performing image processing upon selecting a γ correction table corresponding to ink discharge amount information, only a technique of making density differences due to variations in ink discharge amount become constant regardless of whether the temperature of a head rises or not, is disclosed. However, this method cannot prevent beading caused when the ink discharge amount increases with a rise in head temperature.

SUMMARY OF THE INVENTION

The present invention has been made in consideration of the above conventional techniques, and has as its object to provide an ink-jet printer which prevents ink soaking on a printing medium due to a rise in head temperature by setting the ink discharge amount of an ink-jet head, which increases with a rise in the temperature of the ink-jet head, within the ink receiving capacity of the printing medium, and a control method and apparatus for the ink-jet printer.

It is another object of the present invention to provide an ink-jet printer which improves the quality of a printed image by storing information about variations in the ink discharge amount of each printhead in the memory of each printhead and changing image processing for generating print data in accordance with the information of each printhead, and a control method and apparatus for the ink-jet printer.

It is still another object of the present invention to provide an ink-jet printer which can prevent beading caused by an increase in ink discharge amount with a rise in the temperature of each printhead, and a control method and apparatus for the ink-jet printer.

It is still another object of the present invention to provide an ink-jet printer which stores, in a printhead, ink discharge amount correction information based on dimensional tolerances in the process of manufacturing the printhead, and prints an image by generating print data on the basis of the correction information, and a control method and apparatus for the ink-jet printer.

In order to attain the above-described objects, an ink-jet printer of the present invention comprises the following structure.

An ink-jet printer for printing by discharging ink from an ink-jet head onto a printing medium, the apparatus comprises: read means for reading out head information about an ink discharge amount of the ink-jet head from a memory in which the head information is stored; selection means for selecting a correction table for correcting image data on the basis of the head information read out by said read means; image processing means for generating print data by processing the image data by using the correction table selected by said selection means; and control means for controlling to print an image on a printing medium on the basis of the print data generated by said image processing means, wherein the correction table stores correction data for the image data which is based on a print density on the printing medium and an ink receiving capacity allowed in printing on the printing medium in correspondence with an ink discharge amount characteristic of the ink-jet head.

In order to attain the above-described objects, a control method for an ink-jet printer of the present invention comprises the following steps.

A control method for an ink-jet printer for printing by discharging ink from an ink-jet head onto a printing medium, comprising the steps of: receiving head information about an ink discharge amount of the ink-jet head mounted on the ink-jet printer from the ink-jet printer; selecting a correction table for correcting image data on the basis of the head information received in said receiving step; processing the image data by using the correction table selected in the selection step to generate print data; and transmitting the print data generated in said processing step to the ink-jet printer, wherein the correction table stores correction data for the image data which is based on a print density on the printing medium and an ink receiving capacity allowed in printing on the printing medium in correspondence with an ink discharge amount characteristic of the ink-jet head.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the descriptions, serve to explain the principle of the invention.

FIG. 6 is a view for explaining how beading occurs in correspondence with the respective ink discharge amount ranks of heads;

FIG. 8 is a view for explaining how beading occurs when the gamma correction table shown in FIG. 7 is used;

FIG. 11 is a view showing pieces of ink discharge amount rank information stored in each EEPROM in correspondence with the respective ink discharge amount ranks according to the second embodiment;

FIG. 12 is a view for explaining an increase in ink discharge amount with a rise in temperature in correspondence with the channel height of each printhead;

FIGS. 14A and 14B are views for explaining the contents of ink discharge amount correction for each channel height according to the third embodiment, in which FIG. 14A shows a case where the channel height is 13 $\mu$m, and FIG. 14B shows a case where the channel height is 17 $\mu$m;

DETAILED DESCRIPTION OF THE PREFERRED EMBODIMENTS

The preferred embodiments of the present invention will be described in detail below with reference to the accompanying drawings.

First Embodiment

Figure 1:
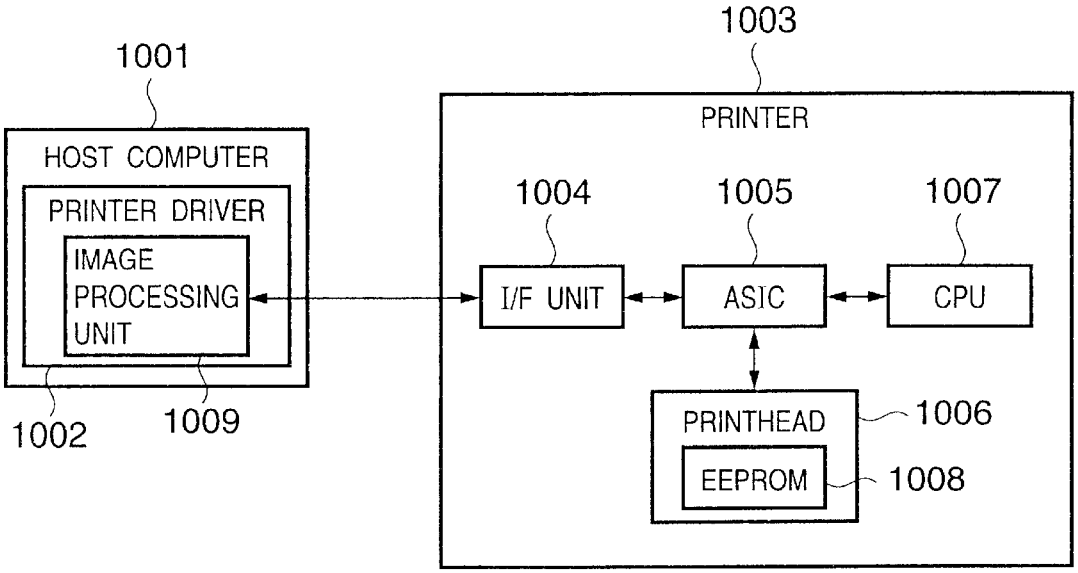
FIG. 1 is a block diagram showing the overall arrangement of an ink-jet printing system according to an embodiment of the present invention.

FIG. 1 is a block diagram showing the arrangement of a printing system including an ink-jet printer 1003 according to the first embodiment of the present invention.

Referring to FIG. 1, reference numeral 1001 denotes a host computer for outputting the image data created by executing an application program or the like to the ink-jet printer 1003; and numeral 1002 denotes a printer driver for causing an image processing unit 1009 to perform image processing for the image data received from the application program in the host computer 1001, creating a print instruction, print data, and the like for the ink-jet printer 1003 on the basis of the processed image data, and outputting them to the ink-jet printer 1003. In addition, the printer driver 1002 receives status information such as error information from the ink-jet printer 1003 by bidirectional communication, or receives ink discharge amount information, head identification information, or the like in a printhead (ink-jet head) 1006, and changes an image processing method in the image processing unit 1009 in accordance with the received information. Such exchange of information and image processing method will be described later. In this embodiment, the image processing unit 1009 is formed by software. However, this unit may be formed by dedicated hardware.

The arrangement of the ink-jet printer 1003 will be described next.

An ASIC (Application specialized for Integrated Circuit or Application Specific IC) 1005 exchanges data with the host computer 1001 through an I/F unit 1004 in the ink-jet printer 1003. A CPU 1007 controls the overall operation of the ink-jet printer 1003 by exchanging data signals and control signals with the ASIC 1005. The ASIC 1005 also exchanges head control signals with the printhead 1006. The CPU 1007 receives control signals for the respective heads through the ASIC 1005 and performs various control operations for head driving. An EEPROM 1008 storing various information about the printhead is mounted in the printhead 1006. The contents of the EEPROM 1008 are transferred to the CPU 1007 through the ASIC 1005 at a predetermined timing.

In order to obtain photo-, high-quality images, the printhead 1006 in the ink-jet printer 1003 according to this embodiment is formed by mounting print element boards for a total of six colors, i.e., Y, M, C, K, LC and LM, on one head unit.

Figure 2A:
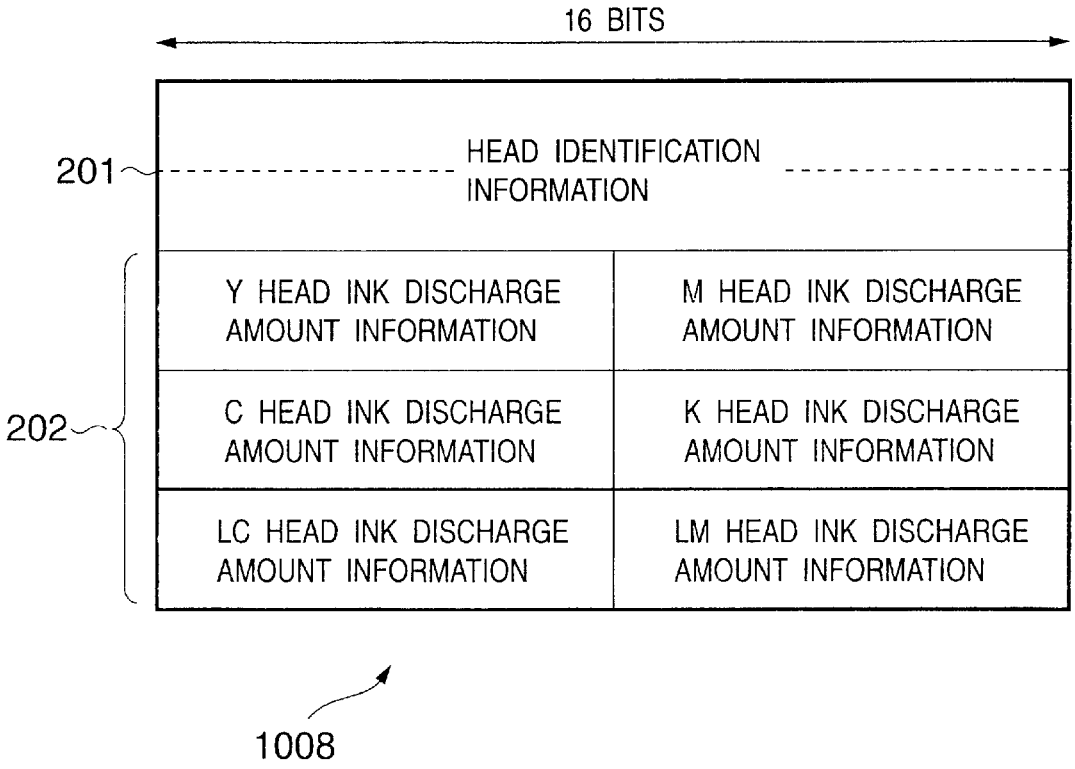
FIGS. 2A and 2B are views respectively showing the memory map of an EEPROM according to the first embodiment of the present invention and a concrete example of the data in the map.
Figure 2B:
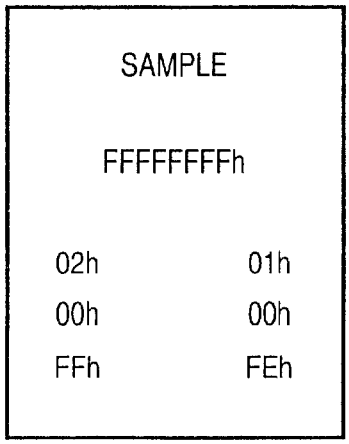

FIG. 2A is a view showing an example of the memory map of the EEPROM 1008 mounted in the printhead 1006 according to this embodiment. FIG. 2B shows a concrete example of the memory map.

As shown in FIG. 2A, the EEPROM 1008 is mapped per word=16 bits, and variable data lengths are assigned depending on the types of information.

Head identification information 201 is 32-bit (2-word) data; information that can be expressed with this data length ($2^{32}$=4,294,967,296 possible pieces of information) is stored as information unique to each printhead. In the example shown in FIG. 2B, the identification information "0FFFFFFFFh" unique to this printhead is stored in the EEPROM 1008.

Reference numeral 202 denotes ink discharge amount information about each color of Y, M, C, K, LC and LM; each information is 8-bit data. This ink discharge amount information represents a discharge amount smaller than a standard discharge amount "0" as a negative value, and a discharge amount larger than the standard discharge amount as a positive value. For example, as shown in FIG. 2B, this information represents a discharge amount in one of five ranks, i.e., −2 (FEh: h represents a hexadecimal number), −1 (FFh), 0 (00h), +1 (01h), and +2 (02h).

In the example shown in FIG. 2B, the heads corresponding to Y and M inks exhibit ink discharge amounts (+2 and +1, respectively) larger than the standard discharge amount; the heads corresponding to C and K inks, ink discharge amounts (both 0) equal to the standard discharge amount; and the heads corresponding to LC and LM inks, ink discharge amounts (−1 and −2, respectively) smaller than the standard discharge amount (the ink discharge amounts of the heads corresponding to the above pieces of ink discharge amount information will be respectively referred to as "double small" (−2), "small" (−1), "intermediate" (0), "large" (1), and "double large" (2) hereinafter).

In this example, only the information associated with this embodiment is written in the EEPROM 1008. However, other pieces of information may also be written. For example, information associated with driving conditions for each head may be written in the EEPROM 1008 in advance, and the ink-jet printer 1003 may read out the information to control each head in optimal driving conditions based on the information. Alternatively, registration information about the printhead 1006 may be written in the EEPROM 1008 to adjust the positions of the respective heads on the basis of the registration information, or information about non-dischargeable nozzles of each head may be written in the EEPROM 1008 to print images while interpolating portions that should be printed by the non-dischargeable nozzles with other normal nozzles.

Such information may be written in the EEPROM 1008 in the read-only mode at the time of shipment of the printhead 1006, or may be written as information that can be updated when the ink discharge amount of the printhead 1006 has been changed with the passage of time. In this case, for the sake of simplicity, assume that these data are written in the EEPROM 1008 in the read-only mode only at the time of shipment.

Figure 3:
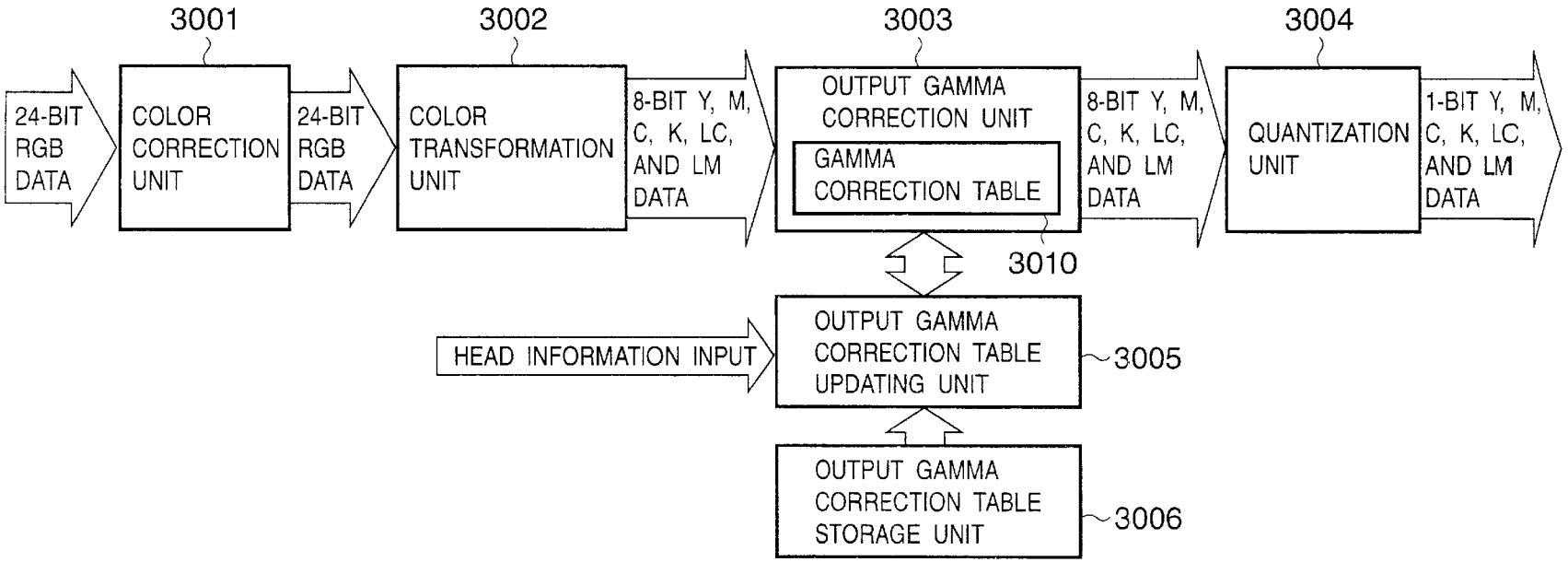
FIG. 3 is a block diagram showing the functional arrangement of the image processing unit of a printer driver according to this embodiment.

FIG. 3 is a block diagram showing the functional arrangement of the image processing unit 1009 of the printer driver 1002 according to this embodiment.

Referring to FIG. 3, reference numeral 3001 denotes a color correction unit for receiving 8-bit R, G, and B image data, i.e., a total of 24-bit image data, and transforms the respective R, G and B data into 24-bit R, G, and B data by 3D LUT transformation. In this case, the transformation is performed from the color space from which the data are input to the standard color space so as to achieve color reproduction uniformity between input/output apparatuses such as the printer, and realizes color reproduction desired by the user or reproduction with print colors desired by the user. Reference numeral 3002 denotes a color transformation unit for transforming R, G and B values having undergone color correction in the color correction unit 3001 into 8-bit Y, M, C, K, LC and LM in the color space of the printer as an output apparatus, i.e., a total of 48-bit data, by using a 3D LUT as well; and numeral 3003 denotes an output gamma correction unit for performing gamma correction for each of the colors Y, M, C, K, LC and LM by using a 1D LUT (gamma correction table 3010), thereby correcting the ink discharge amount of the head for each color by using the gamma corrected image data.

Figure 4:
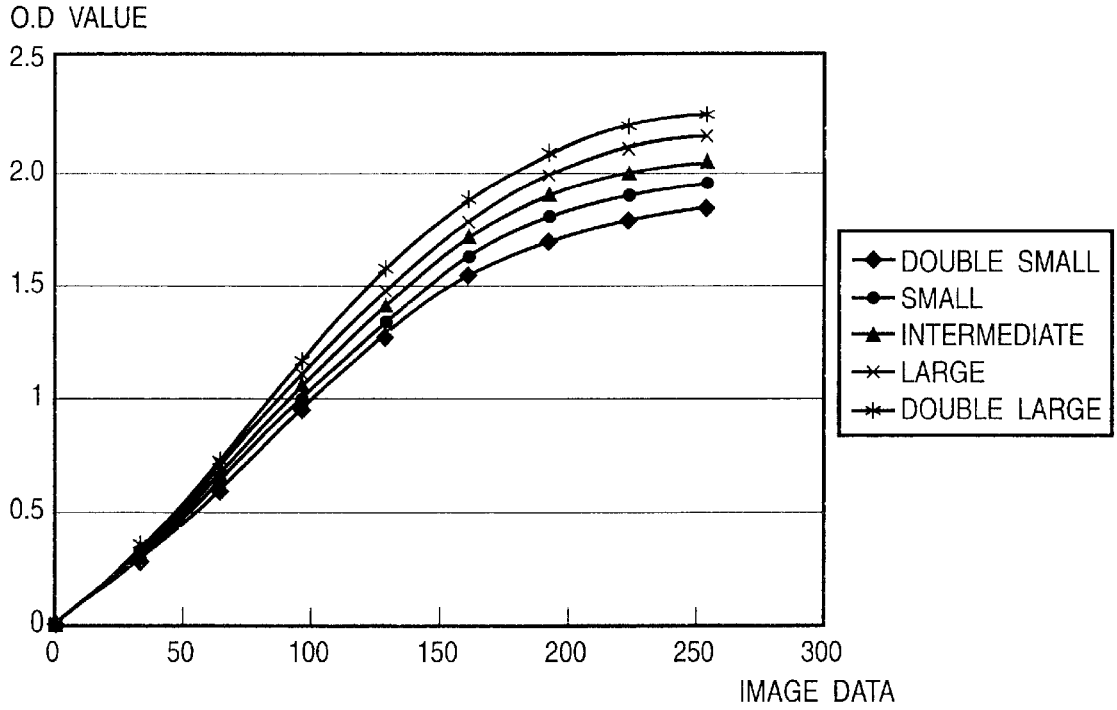
FIG. 4 is a graph showing image data/print density characteristics.

FIG. 4 is a graph for explaining a gamma correction characteristic for each ink discharge amount corrected by the output gamma correction unit 3003.

Referring to FIG. 4, the abscissa represents the 8-bit ("0" to "255") image data value of each color before gamma correction; and the ordinate, the reflection density (O.D value) obtained when a solid patch is printed on the basis of the image data value. Obviously, as the ink discharge amount increases, the O.D value increases with respect to each gray level, and vice versa. The output gamma correction unit 3003 performs gamma correction by using the gamma correction table 3010 having output gamma correction characteristics like those shown in FIG. 5 to make O.D values exhibit linear characteristics with respect to inputs in consideration of the above output gamma characteristics.

This output gamma correction table 3010 is prepared in accordance with the ink discharge amount of each head, and is stored as the gamma correction table 3010 in the output gamma correction unit 3003. The number of types of gamma correction tables 3010 may be equal to the number of ranks (five ranks) of ink discharge amount information stored in the EEPROM 1008. Alternatively, a smaller number (e.g., three) of types of gamma correction tables 3010 may be prepared, and gamma correction may be performed for missing information by interpolation calculation.

In the first embodiment, the gamma correction table 3010 is used to correct variations in the ink discharge amount of each head. However, the present invention is not limited to this. For example, a plurality of LUTs like those in the color correction unit 3001 for performing the above color processing and in the color transformation unit 3002 may be prepared in accordance with the ink discharge amounts of the respective heads, and correction may be performed by switching the tables to be used in accordance with the respective heads. Reference numeral 3006 denotes an output gamma correction table storage unit storing a plurality of gamma correction tables in correspondence with the respective types of head information.

An output gamma correction table updating unit 3005 receives the head information stored in the EEPROM 1008 mounted in the printhead 1006. Upon detecting that a printhead with an ink discharge amount different from the information in the gamma correction table 3010 stored in the output gamma correction unit 3003 is mounted, the output gamma correction table updating unit 3005 reads out the gamma correction table corresponding to the ink discharge amount of the printhead 1006 from the output gamma correction table storage unit 3006 on the basis of the ink discharge amount information stored in the EEPROM 1008 of the printhead 1006, and sends the table to the output gamma correction unit 3003, thereby updating the gamma correction table 3010 in the output gamma correction unit 3003.

A quantization unit 3004 receives the 8-bit data of each color (Y, M, C, K, LC and LM) gamma-corrected by the output gamma correction unit 3003, and quantizes each data into data with the number of gray levels that can be expressed by the ink-jet printer 1003, e.g., 1-bit binary data in the case shown in FIG. 3. In general, for this quantization processing, dither processing or error diffusion processing capable of pseudo halftone expression is used.

Correction processing based on the gamma correction for the ink discharge amount of the printhead will be described next.

FIG. 6 is a view showing a conversion discharge amount after ink discharge amount correction for correction of density differences due to ordinary variations in ink discharge amount, a change in ink discharge amount with a rise in the temperature of the printhead, and the state of occurrence of beading in correspondence with each of five ranks in which the ink discharge amounts of the printhead are classified within the specification range. In this embodiment, the median of ink discharge amounts is 4.5 ng during normal operation, and tolerance variations of ±0.7 ng are set around the median.

A conversion ink discharge amount after the ink discharge amount correction will be described next.

Figure 5:
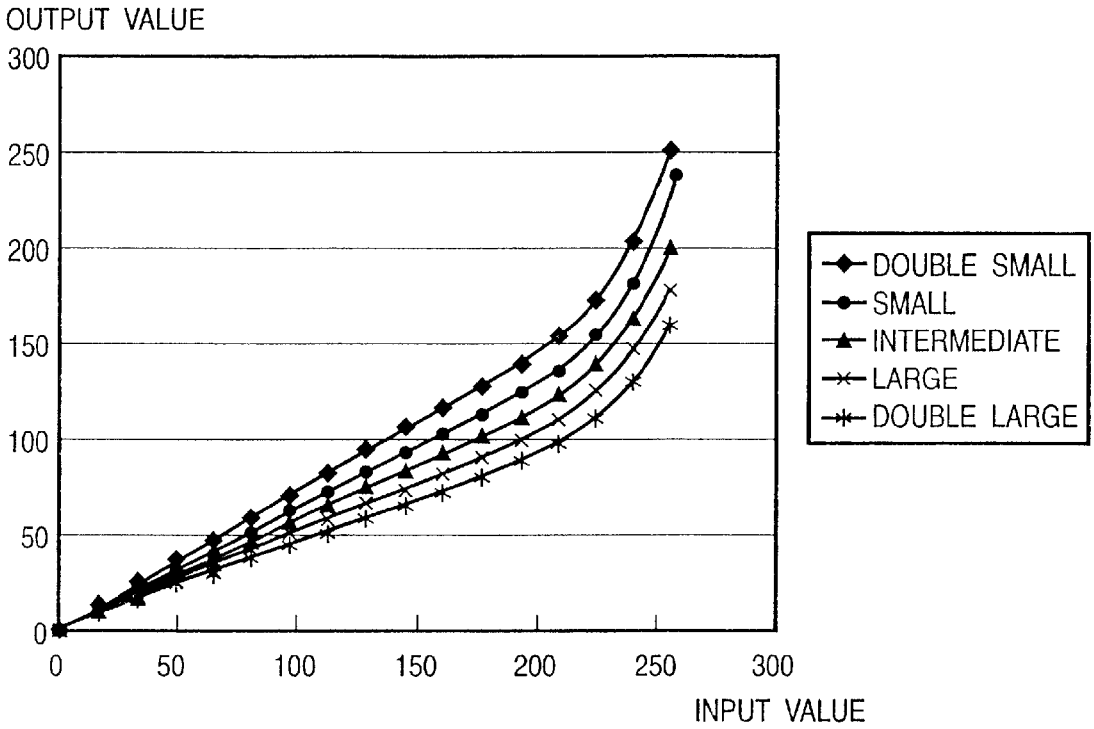
FIG. 5 is a graph for explaining the data characteristics of a gamma correction table for correcting the characteristics in FIG. 4.

Assume that ink discharge amount correction is to be performed by preparing gamma correction tables for the respective ranks of ink discharge amounts of each printhead in order to correct density differences due to variations in the ink discharge amount of each printhead. In this case, the maximum output value from a gamma correction table with respect to the printhead of the rank "double small" corresponding to the smallest ink discharge amount is "255". The ink discharge amount corresponding to this maximum value "255" is set to the upper limit of the amount of ink that can be landed per color by the printhead. Since a value larger than this value cannot be output to other printheads, the maximum output values of the tables in the remaining ranks are set to be smaller than "255". For example, as shown in FIG. 5, tables storing correction values that make output values (ink landing amounts) smaller than input values as a whole are used.

As shown in FIG. 6, in the printhead of the rank "double small" of ink discharge amounts, the normal ink discharge amount is 3.8 to 4.0 ng, and the ink discharge amount after correction by the gamma correction table is 3.8 to 4.0 ng. In this rank, the maximum output value is "255". In contrast to this, in the rank "small" of ink discharge amounts, the normal ink discharge amount is 4.0 to 4.3 ng, and the maximum output value is "248" (FIG. 5). On average, therefore, the number of dots landed per unit area is decreased to "248/255"=97.5%. When the amount of ink landed per unit area at this time is converted into an ink discharge amount corresponding to the maximum signal value "255", the conversion amount is 3.9 to 4.2 ng. These values are set as conversion ink discharge amounts after ink discharge amount correction. In this manner, conversion ink discharge amounts (ng) after the ink discharge amount correction are obtained in the five ink discharge amount ranks shown in FIG. 6.

As the temperature of the printhead according to this embodiment rises, the ink discharge amount increases by a maximum of 1.0 ng in each rank. Therefore, values like those shown in FIG. 6 are set in the "ink discharge amount in process of temperature rise" field in consideration of the fact that each ink discharge amount in the process of a temperature rise becomes larger than the corresponding conversion ink discharge amount in FIG. 6 by 1.0 ng.

Assume that when an image is printed on a predetermined printing medium by using a printhead having such an ink discharge amount characteristic, beading occurs if the conversion ink discharge amount exceeds 5.5 ng.

This phenomenon will be considered with reference to FIG. 6. In the ink discharge amount ranks from "double small" to "intermediate", since the discharge amount is 5.5 ng or less even in consideration of an increase in ink discharge amount with a rise in temperature (a maximum of 1.0 ng), no beading occurs. In contrast to this, in the ink discharge amount rank of "large", beading may occur. In the ink discharge amount rank of "double large", beading always occurs in an image portion on which a large amount of ink (more than 5.5 ng) is landed in the process of a temperature rise.

Figure 7:
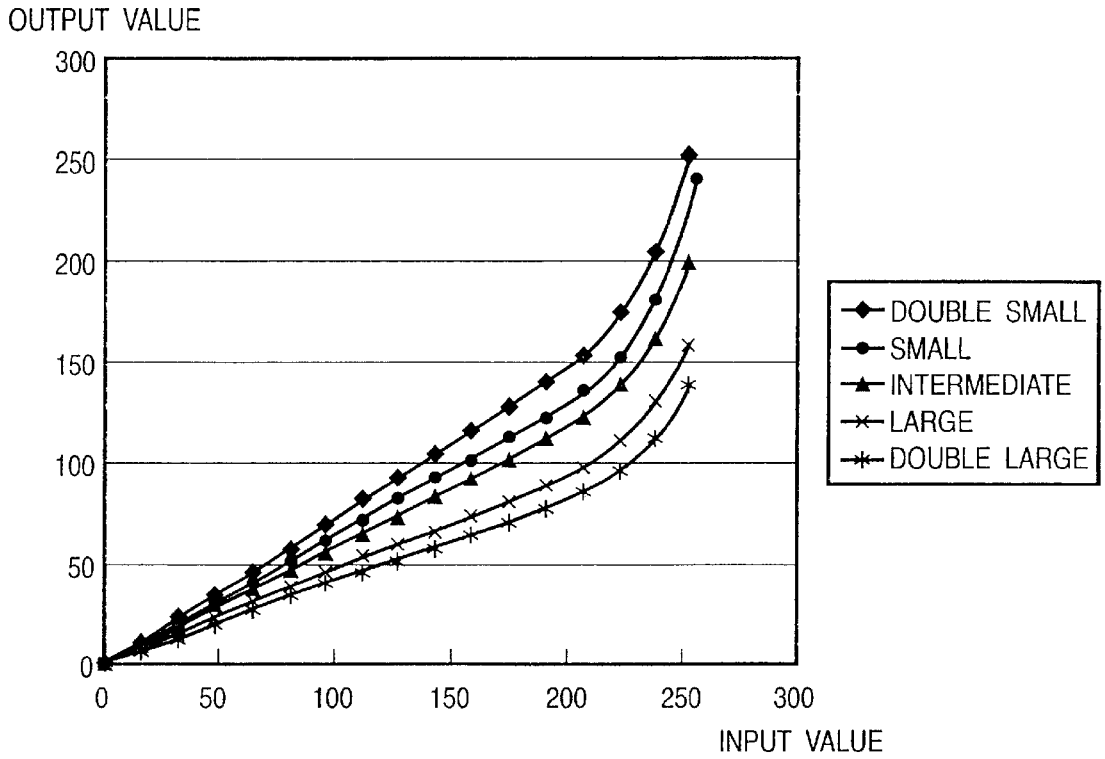
FIG. 7 is a graph showing the characteristics of a gamma correction table for preventing beading according to the first embodiment.

In the ink discharge amount correction method according to the first embodiment, to prevent the occurrence of beading, a gamma correction table having a characteristic like that shown in FIG. 7 is used in correspondence with each ink discharge amount rank.

The gamma correction table characteristics shown in FIG. 7 are set with respect to gamma correction table characteristics like those shown in FIG. 5 which are set to correct density differences caused by variations in ink discharge amount. In this case, the gamma correction table for ranks in which no beading occurs, i.e., the ranks "double small", "small", and "intermediate" in this case, uses the same table characteristics as those shown in FIG. 5. In the case shown in FIG. 7, the correction table for the ranks "large" and "double large" exhibits a characteristic in which the ink landing amount is decreased to prevent the occurrence of beading, as compared with the gamma correction table shown in FIG. 5.

FIG. 8 is a view for explaining conversion ink discharge amounts based on the table characteristics shown in FIG. 7. In this case, no beading occurs in all the ink discharge amount ranks even in consideration of an increase in ink discharge amount (1.0 ng) with a rise in temperature.

Figure 9:
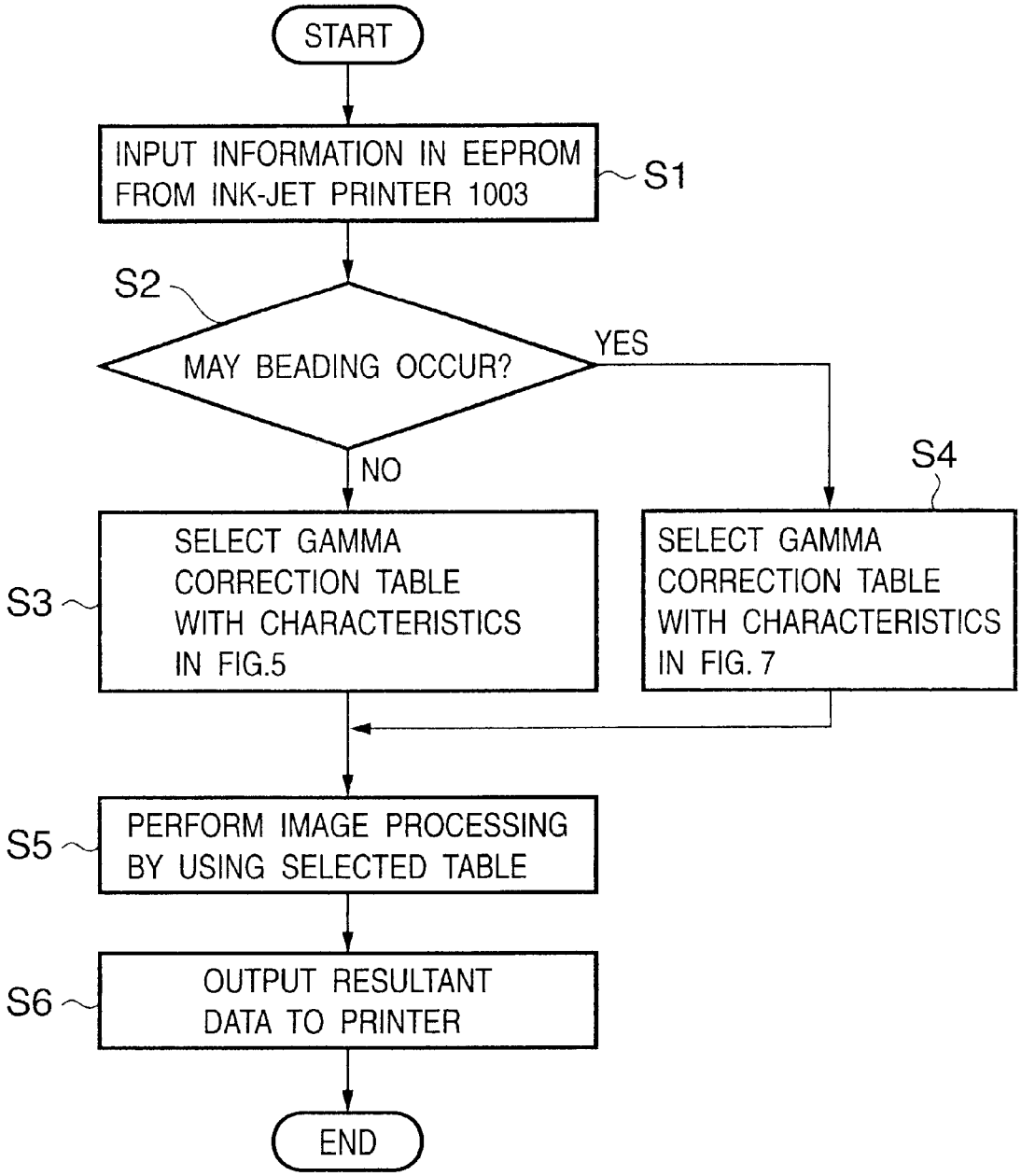
FIG. 9 is a flow chart showing the processing performed by a printer driver according to the first embodiment of the present invention.

FIG. 9 is a flow chart showing processing in the printer driver 1002 according to the first embodiment of the present invention.

In step S1, the printer driver 1002 receives the head information stored in the EEPROM 1008 mounted in the printhead 1006 of the ink-jet printer 1003, which is sent from the ink-jet printer 1003, and obtains the ink discharge amount information about the printhead 1006 for each color on the basis of the head information. In step S2, the printer driver 1002 determines a discharge amount rank on the basis of the ink discharge amount information about each printhead 1006, and obtains a conversion ink discharge amount after the ink discharge amount correction for each printhead by referring to the gamma correction table held in the image processing unit 1009. The printer driver 1002 determines based on this value whether ink soaking (beading) occurs in consideration of an ink amount increase of 1.0 ng with a rise in the temperature of each printhead. That is, the printer driver 1002 determines whether the ink discharge amount after correction exceeds 5.5 ng. If no printhead exhibits an ink discharge amount exceeding this value, the flow advances to step S3 to select the gamma correction table having the gamma characteristics shown in FIG. 5.

If a printhead in which beading may occur, e.g., the printhead 1006 whose ink discharge amount is in the rank "large" or "double large" in the case shown in FIG. 6, is mounted in the ink-jet printer 1003, the flow advances to step S4 to select a gamma correction table having correction characteristics, like those shown in FIG. 7, which suppress the occurrence of beading. Note that this gamma correction table selection processing is equivalent to the function of the output gamma correction table updating unit 3005 described above.

If a gamma correction table is selected in step S3 or S4 in this manner, the flow advances to step S5 to cause the image processing unit 1009 to execute image processing by using the selected gamma correction table so as to create print data and a print instruction. The flow then advances to step S6 to send the print data and the like created in this manner to the ink-jet printer 1003, thus executing printing operation.

As described above, according to the first embodiment of the present invention, beading due to an increase in ink discharge amount in each printhead is suppressed/controlled while variations in ink discharge amount in each printhead which occurred at the time of shipment are corrected, thereby preventing a deterioration in image quality due to beading and maintaining good image quality.

In the first embodiment, gamma correction tables are held for all the ink discharge amount ranks. However, a gamma correction table for an ink discharge amount rank, in which beading occurs, may be obtained from the conversion value of the ink discharge amount based on a gamma correction table for a given rank as a reference by, for example, interpolation calculation.

Second Embodiment

In the second embodiment, a plurality of gamma correction tables created in consideration of variations in the ink discharge amounts of the respective printheads are prepared for a printer driver 1002, and rank information about each printhead is written in an EEPROM 1008 of a corresponding printhead 1006. According to a characteristic feature of this embodiment, only in ranks in which beading may occur, values deviated from the actual values in the ranks are written, and gamma correction tables corresponding to the written rank values are set, thereby correcting the ink discharge amounts of the respective printheads.

Figure 10:
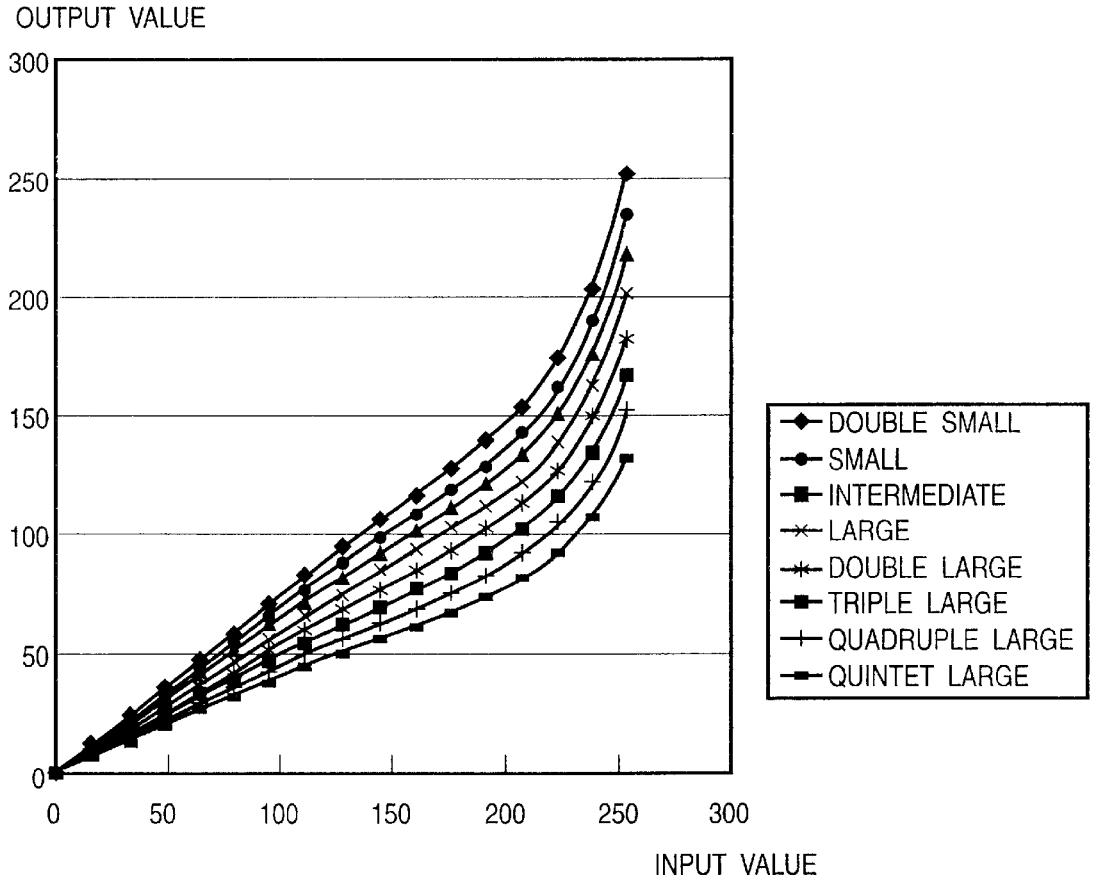
FIG. 10 is a graph for explaining the characteristics of a gamma correction table according to the second embodiment of the present invention.

FIG. 10 is a graph showing gamma correction characteristics corresponding to printheads in a plurality of ink discharge amount ranks which are prepared for an ink-jet printer 1003.

In the second embodiment, eight gamma correction tables are prepared in correspondence with eight ranks. FIG. 11 shows the data written in the "rank value" fields corresponding to these eight ranks. The correction amounts as conversion ink discharge amounts corresponding to the respective ranks are: 0 ng in the rank "double small" in which the ink discharge amount is the smallest, −0.1 ng in the rank "small", −0.2 ng in the rank "intermediate", . . . , −0.7 ng in the rank "quintet large".

FIG. 11 is a view showing rank values, conversion ink discharge amount correction ranges, normal ink discharge amounts, conversion ink discharge amount after correction, ink discharge amounts in the process of a temperature rise, and the like in correspondence with these eight types of rank information.

Referring to FIG. 11, the correction amounts correspond to ink discharge amount rank values and correction ranges set without consideration of increases in ink discharge amount with a rise in temperature with respect to the ink discharge amount ranks "double small", "small", "intermediate", "large", and "double large" in the first embodiment (FIG. 8) described above.

As described in the first embodiment with reference to FIG. 6, in the process of a temperature rise, beading does not occur in the ranks "double small", "small", and "intermediate", and occurs only in the ranks "large" and "double large". With respect to heads in the ink discharge amount ranks "double small", "small", and "intermediate", pieces of actual discharge amount rank information "double small", "small", and "intermediate" (rank values of −2, −1, and 0) are written without any change. With respect to heads in the ink discharge amount ranks "large" and "double large", to prevent beading that can occur with an increase in ink discharge amount with a rise in temperature, pieces of ink discharge amount rank information with large conversion ink discharge amount correction ranges are selected, and the corresponding rank values ("3" and "5") are written in the EEPROMs of the respective printheads.

For the printhead with the actual ink discharge amount in the rank "large", "−0.5 ng" is required as a conversion ink discharge amount correction range, and hence "triple large (rank value "3")" is written as discharge amount rank information. For the printhead with the actual ink discharge amount in the rank "double large", since "−0.7 ng" is required as a conversion discharge amount correction range, "quintet large (rank value "5")" is written as ink discharge amount rank information. As shown in FIG. 11, therefore, five different rank values, i.e., "−2", "−1" "0", "3", and "5", are respectively written in the printheads with the five ranks "double small", "small", "intermediate", "large", and "double large" as actual ink discharge amount ranks.

The printheads 1006 in which the above rank values are stored, respectively, are mounted in the ink-jet printer 1003. The ink-jet printer 1003 sends these rank values ("−2", "−1", "0", "3" and "5") as pieces of ink discharge amount rank information to the printer driver 1002 of a host computer 1001. With this operation, the corresponding gamma correction tables are selected among gamma correction tables having the gamma correction characteristics shown in FIG. 10, and gamma correction processing is performed.

In this manner, in the second embodiment, in correcting ink discharge amounts in consideration of the prevention of beading in the process of a rise in the temperature of each printhead 1006, actual ink discharge amount rank information is written to use tables with characteristics different from those for gamma correction that is executed to correct only density differences with respect to the ink discharge amount ranks in which beading may occur. In addition, ink discharge amount rank information is written to use gamma correction tables specialized for density difference correction with respect to ranks in which beading will never occur.

As described above, according to the second embodiment, parameters that are expected to be used in correction processing are prepared in the printer driver 1002 in advance, to make rank information differ from actual ink discharge amount ranks upon writing the rank information in the EEPROM 1008 of each printhead 1006. This makes it possible to determine the contents of gamma correction processing in the printer driver 1002 by only changing the rank information in the EEPROM 1008. Assume that the characteristics of the printhead 1006 are improved; for example, the printhead is improved into a printhead whose ink discharge amount does not change even with a rise in temperature or a printhead whose ink discharge amount does not easily change. In this case, a gamma correction table for correcting density differences due to variations in ink discharge amount can be selected by changing the ink discharge amount rank information in the EEPROM 1008 mounted in this printhead.

Third Embodiment

The third embodiment is characterized in that information indicating a head ink channel height having a high correlation with an increase in ink discharge amount with a rise in temperature, of dimensional tolerances in the process of manufacturing the printhead, is stored in an EEPROM 1008, and a gamma correction table corresponding to the ink discharge amount rank is selectively used on the basis of the stored information in the EEPROM 1008.

Figure 15:
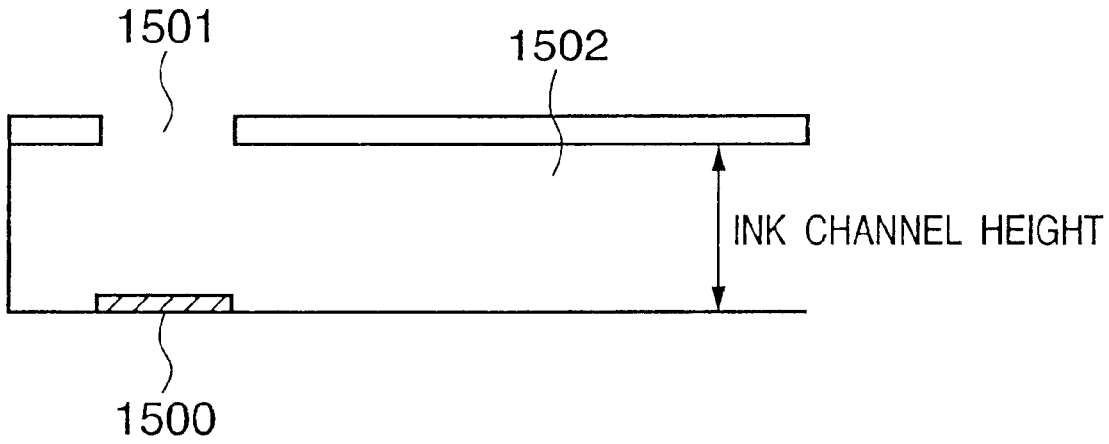
FIG. 15 is a view for explaining the channel height of a printhead according to the third embodiment.

The printhead ink channel height in this case indicates the distance indicated by the arrow in FIG. 15, i.e., the distance from an ink channel 1502 to an orifice 1501. The head shown in FIG. 15 is designed such that an air bubble is generated in the ink channel 1502 by the heat liberated by a heater 1500, and ink is discharged from the orifice 1501 by the pressure produced upon generation of the air bubble. The ink is discharged in the upward direction in FIG. 15. The height of this ink channel 1502 is closely associated with the ink refill characteristic of the printhead. More specifically, this height influences the ability to supply ink equivalent to discharged ink into the ink channel 1502 after the ink has been discharged. As the height of the ink channel 1502 increases, the ink refill speed increases. In contrast to this, as the height of the ink channel 1502 decreases, the refill characteristic deteriorates, and a longer period of time is required for refill operation.

Printheads according to the third embodiment are designed on the basis of a standard ink channel height of 15 μm with tolerances of 2 μm as manufacturing variations. At the upper limit, lower limit, and median of the tolerances, the ink discharge amounts of printheads increase differently with a rise in temperature. More specifically, the ink discharge amount of the printhead with the ink channel 1502 having a height of 13 μm increases by about 0.5 ng. The ink discharge amount of the printhead with an ink channel height of 15 μm (the printhead described in the first embodiment) increases by about 1.0 ng. The ink discharge amount of the printhead with an ink channel height of 17 μm increases by about 1.5 ng. This is because, as the amount of ink supplied in refill operation increases with an increase in the ink channel height, the ink discharge amount increases with a rise in the temperature of the printhead.

Figure 13A:
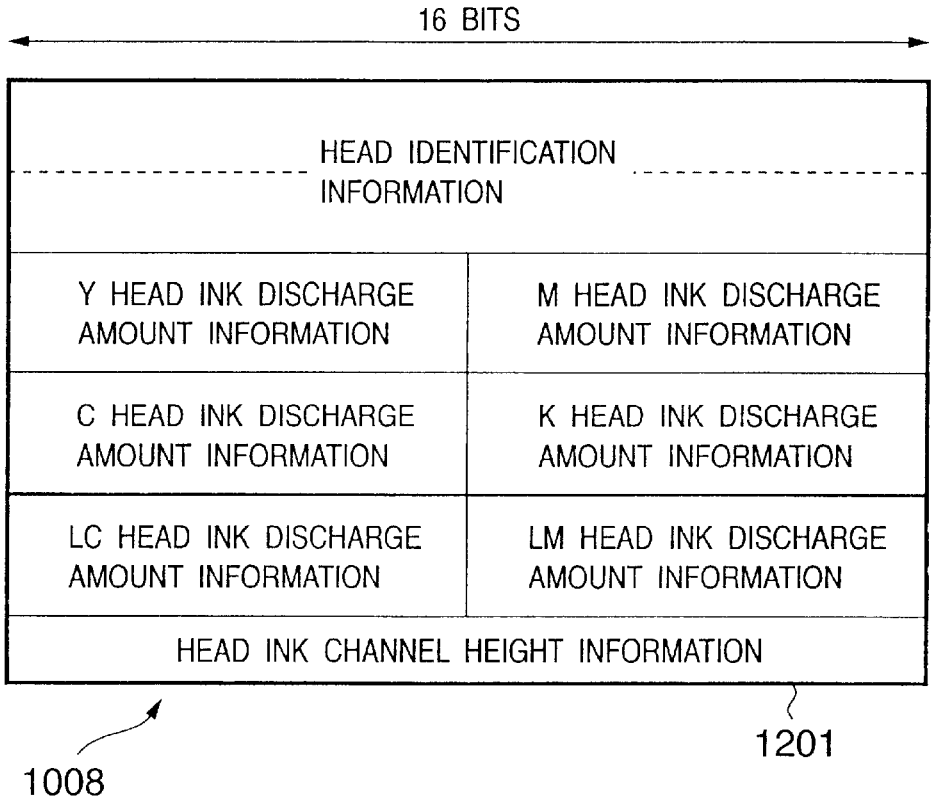
FIGS. 13A and 13B are views respectively showing the memory map of an EEPROM according to the third embodiment of the present invention and a concrete example of the data in the map.

In this case, as shown in FIG. 13A, the ink channel heights of the printheads are classified in three ranks, and height information 1201 about the ink channel 1502 is added as information identifying a corresponding rank to the head information to be written in the EEPROM 1008 of each printhead 1006. For example, this information 1201 is 13 (000Dh) for an ink channel height of 13 μm; 15 (000Fh) for an ink channel height of 15 μm; and 17 (0011h) for an ink channel height of 17 μm.

Figure 13B:
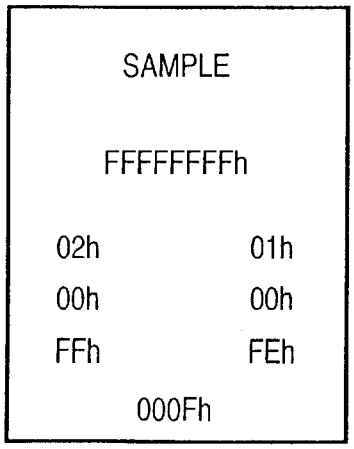

FIG. 13B is a view showing an example of head information written in the EEPROM 1008. In this case, the height information 1201 about the printhead is "00Fh"; the ink channel height is 15 μm.

FIGS. 14A and 14B are views for explaining a method of correcting an ink discharge amount in accordance with an ink channel height. In this case, since the ink discharge amount correction method used when the ink channel height is 15 μm, which is the median of the tolerances, is the same as that in the first embodiment, a description thereof will be omitted.

FIG. 14A is a view for explaining correction data for ink discharge amounts when the ink channel height is 13 μm. Since the ink discharge amount increase due to a temperature rise is 0.5 ng, even if a table having the gamma correction characteristics shown in FIG. 6 is used, the ink discharge amount in the process of a temperature rise does not exceed 5.5 ng, at which beading occurs, with a conversion ink discharge amount correction range set for correction of only density differences due to variations in discharge amount (i.e., 0 to −0.4 ng). For the printhead with an ink channel height of 13 μm, therefore, correction of only density differences due to variations in ink discharge amount, shown in FIG. 6, may be done without any change with respect to the respective ink discharge amount ranks.

In the case of a printhead having a channel height of 17 μm shown in FIG. 14B, the ink discharge amount increase with a rise in temperature is 1.5 ng. In the discharge amount rank "double small", the ink discharge amount in the process of a rise in head temperature does not exceed 5.5 ng. In the remaining ranks, if an ink discharge amount increase of 1.5 ng with a rise in temperature is added to the normal ink discharge amounts, all ink discharge amounts exceed 5.5 ng due to the rise in temperature, if conversion ink discharge amount correction values 0 to −0.4 are used. For this reason, a gamma correction table in which the maximum conversion ink discharge amount correction range is set to −1.2 ng to perform ink discharge amount correction as shown in FIG. 14B must be used.

All gamma correction tables for the three different ink channel heights like those shown in FIGS. 14A, 14B, and 12 are prepared for a printer driver 1002. An ASIC 1005 and CPU 1007 of ink-jet printer 1003 read out the ink discharge amount rank information and ink channel height information written in the EEPROM 1008 of the printhead 1006. The read data are then sent to the printer driver 1002 through a printer interface 1004. With this operation, the printer driver 1002 selects a corresponding gamma correction table and performs image processing.

Figure 16:
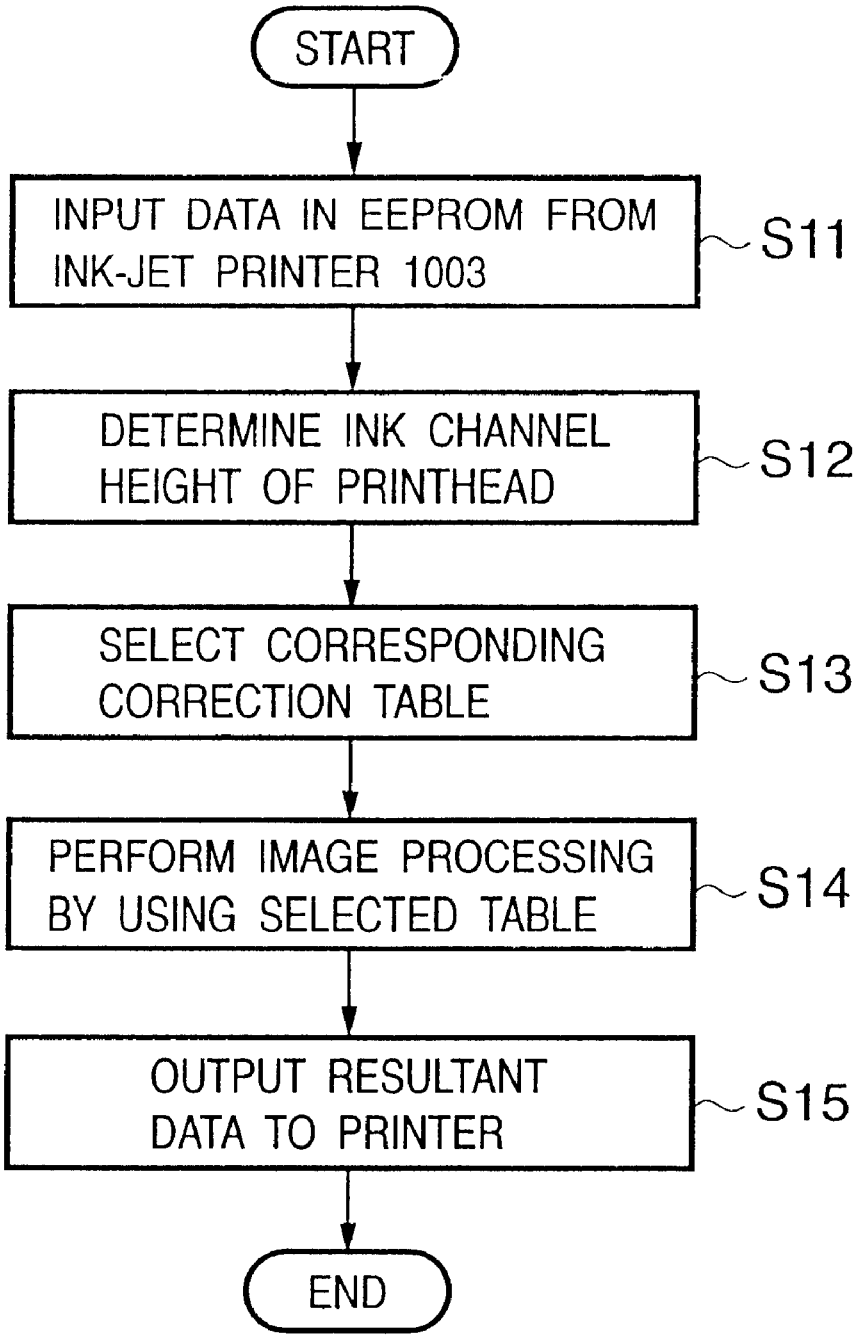
FIG. 16 is a flow chart showing the processing performed by a printer driver according to the third embodiment of the present invention.

FIG. 16 is a flow chart showing the processing performed by the printer driver 1002 according to the third embodiment of the present invention.

In step S11, the printer driver 1002 receives the head information stored in the EEPROM 1008 mounted in each printhead 1006 of the ink-jet printer 1003, which is sent from the ink-jet printer 1003, and obtains ink discharge amount information about the printhead for each color on the basis of the head information. The flow advances to step S12 to obtain the channel height of each printhead 1006. As described above, this ink channel height can be obtained by reading out the ink channel height information written in the EEPROM 1008 of each printhead 1006. The flow then advances to step S13 to select the corresponding gamma correction table held in an image processing unit 1009 on the basis of this ink channel height. Note that this direction of thickness selection processing corresponds to the function of the output gamma correction table updating unit 3005 described above.

When a gamma correction table is selected in this manner in step S13, the flow advances to step S14 to cause the image processing unit 1009 to create print data and a print instruction by executing image processing by using the selected gamma correction table. The flow then advances to step S15 to send the print data and the like created in this manner to the ink-jet printer 1003, thus executing the printing operation.

As described above, according to the third embodiment, a gamma correction table used for ink discharge amount correction is selected and used in accordance with two types of information, i.e., an increase in ink discharge amount with a rise in head temperature and the ink channel height having a high correlation with this ink discharge amount increase. This makes it possible to perform fine control in accordance with initial variations in ink discharge amount within the tolerance range of the head and variations in ink discharge amount. This can prevent a deterioration in image quality due to beading and minimize variations in image quality.

In each embodiment described above, the printer driver on the host computer side performs image processing for the creation of print data to be sent to the ink-jet printer. However, the present invention is not limited to this. The ink-jet printer may execute image processing corresponding to each printhead mounted in the ink-jet printer in place of the host computer.

The first to third embodiments have been described singly. However, the present invention is not limited to this and may be implemented by properly combining these embodiments.

The present invention may be applied to a system constituted by a plurality of devices (e.g., a host computer, an interface device, a reader, a printer, and the like) or an apparatus comprising a single device (e.g., a copying machine, a facsimile apparatus, or the like).

In each embodiment described above, the printer driver of the host computer selects gamma correction tables and executes image processing. However, the present invention is not limited to this. For example, the CPU of the ink-jet printer 1003, a dedicated circuit, or the like may execute this processing.

The object of the present invention is realized even by supplying a storage medium storing software program codes for realizing the functions of the above-described embodiments to a system or apparatus, and causing the computer (or a CPU or an MPU) of the system or apparatus to read out and execute the program codes stored in the storage medium. In this case, the program codes read out from the storage medium realize the functions of the above-described embodiments by themselves, and the storage medium storing the program codes constitutes the present invention. The functions of the above-described embodiments are realized not only when the readout program codes are executed by the computer but also when the OS (Operating System) running on the computer performs part or all of actual processing on the basis of the instructions of the program codes.

The functions of the above-described embodiments are also realized when the program codes read out from the storage medium are written in the memory of a function expansion card inserted into the computer or a function expansion unit connected to the computer, and the CPU of the function expansion card or function expansion unit performs part or all of actual processing on the basis of the instructions of the program codes.

The present invention described above has exemplified a printer, which comprises means (e.g., an electrothermal transducer, laser beam generator, and the like) for generating heat energy as energy utilized upon execution of ink discharge, and causes a change in state of ink by the heat energy, among the ink-jet printers. According to this ink-jet printer and printing method, a high-density, high-resolution printing operation can be attained.

As the typical arrangement and principle of the ink-jet printing system, those disclosed in, for example, U.S. Pat. Nos. 4,723,129 and 4,740,796, are preferable. The above is applicable to either one of so-called on-demand type and continuous type systems. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printing head, and consequently, a bubble can be formed in the liquid (ink) in one-to-one correspondence with the driving signal. By discharging the liquid (ink) through an orifice by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printing head, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

In addition, not only an exchangeable chip type printing head, as described in the above embodiments which can be electrically connected to the apparatus main unit and can receive ink from the apparatus main unit upon being mounted on the apparatus main unit, but also a cartridge type printing head in which an ink tank is integrally arranged on the printing head itself can be applicable to the present invention.

It is preferable to add recovery means for the printing head, preliminary auxiliary means, and the like provided as an arrangement of the printer of the present invention since the printing operation can be further stabilized. Examples of such means include, for the printhead, capping means, cleaning means, pressurization or suction means, and preheating means using electrothermal transducers, another heating element, or a combination thereof. It is also effective for stable printing to provide a predischarge mode which performs discharge independently of printing.

In addition to the print mode of printing images only in a main color such as black, the printer may have at least one of the print mode of printing images in different colors and the print mode of printing images in full-color as a mixture of colors, which mode may be realized by an integral printhead or a combination of a plurality of printheads.

As has been described above, even if the respective heads exhibit variations in discharge amount, changes in color appearance can be minimized by writing information about the variations in the EEPROM of each printhead in advance and changing parameters for image processing in the printer driver on the basis of the information.

In addition, beading due to an increase in ink discharge amount with a rise in head temperature can be simultaneously prevented. In this case, the characteristics of gamma correction tables for only ink discharge amount ranks in which beading may occur are changed. This makes it possible to obtain images having almost the same color appearance and density in ranks in which no beading occurs, resulting in an improvement in image quality.

The present invention is not limited to the above embodiments and various changes and modifications can be made within the spirit and scope of the present invention. Therefore, to apprise the public of the scope of the present invention the following claims are made.

What is claimed is:

1. An ink-jet printer for printing by discharging ink from an ink-jet head onto a printing medium, comprising:

read means for reading out head information regarding an ink discharge amount of the ink-jet head from a memory mounted in the ink-jet head, in which the head information is stored;

selection means for selecting a correction table for correcting image data on the basis of the head information read out by said read means;

image processing means for generating print data by processing the image data by using the correction table selected by said selection means; and control means for controlling to print an image on a printing medium on the basis of the print data generated by said image processing means, wherein the correction table stores correction data for the image data which is based on a print density on the printing medium and an ink receiving capacity allowed in printing on the printing medium in correspondence with ink discharge amount characteristics of the ink-jet head.

2. The printer according to claim 1, wherein the ink-jet head and the memory are provided plural in number and one of the memories is mounted in each ink-jet head.

3. The printer according to claim 1, wherein the head information represents the ink discharge amount characteristics of the ink-jet head in a plurality of ranks.

4. The printer according to claim 1, wherein the correction table includes correction data obtained in consideration of an ink discharge amount which changes with a rise in a temperature of the ink-jet head.

5. The printer according to claim 1, wherein the head information includes information regarding a height of an ink channel of the ink-jet head.

6. A control method for an ink-jet printer for printing by discharging ink from an ink-jet head onto a printing medium, comprising the steps of:

reading out head information regarding an ink discharge amount of the ink-jet head from a memory mounted in the ink-jet head, in which the head information is stored;

selecting a correction table for correcting image data on the basis of the head information read out in said reading step;

generating print data by processing the image data by using the correction table selected in said selecting step; and controlling to print an image on a printing medium on the basis of the print data generated in said generating step, wherein the correction table stores correction data for the image data which is based on a print density on the printing medium and an ink receiving capacity allowed in printing on the printing medium in correspondence with ink discharge amount characteristics of the ink-jet head.

7. The method according to claim 6, wherein the head information represents the ink discharge amount characteristics of the ink-jet head in a plurality of ranks.

8. The method according to claim 6, wherein the correction table includes correction data obtained in consideration of an ink discharge amount which changes with a rise in a temperature of the ink-jet head.

9. The method according to claim 6, wherein the head information includes information regarding a height of an ink channel of the ink-jet head.

10. The method according to claim 6, wherein the correction table includes correction data for generating the print data for setting an ink discharge amount to be not more than an ink receiving capacity of the printing medium.

11. A computer-readable storage medium that stores a program for executing a control method for the ink-jet printer defined in claim 6.

12. A control method for an ink-jet printer for printing by discharging ink from an ink-jet head onto a printing medium, comprising the steps of:

receiving head information regarding an ink discharge amount of the ink-jet head mounted on the ink-jet printer from the ink-jet printer, wherein the head information is stored in a memory mounted in the ink-jet head;

selecting a correction table for correcting image data on the basis of the head information received in said receiving step;

processing the image data by using the correction table selected in the selection step to generate print data; and transmitting the print data generated in said processing step to the ink-jet printer, wherein the correction table stores correction data for the image data which is based on a print density on the printing medium and an ink receiving capacity allowed in printing on the printing medium in correspondence with ink discharge amount characteristics of the ink-jet head.

13. A computer-readable storage medium that stores a program for executing a control method for the ink-jet printer defined in claim 12.

14. A control apparatus for an ink-jet printer for printing by discharging ink from an ink-jet head onto a printing medium, comprising:

reception means for receiving head information regarding an ink discharge amount of the ink-jet head mounted on the ink-jet printer from the ink-jet printer, wherein the head information is stored in a memory mounted in the ink-jet head;

selection means for selecting a correction table for correcting image data on the basis of the head information received by said reception means;

image processing means for generating print data by processing the image data by using the correction table selected by said selection means; and transmission means for transmitting the print data generated by said image processing means to the ink-jet printer, wherein the correction table stores correction data for the image data which is based on a print density on the printing medium and an ink capacity allowed in printing on the printing medium in correspondence with ink discharge amount characteristics of the ink-jet head.

15. A correction data table for storing correction data to be used for generating print data in an ink-jet printer having an ink-jet head for discharging ink, wherein the correction data transforms input image data into the print data in correspondence with rank information representing ink discharge characteristics of the ink-jet head in a plurality of ranks, and the print data sets an amount of ink discharged from the ink-jet head to be not more than a predetermined amount, based on an ink receiving capacity allowed in printing on the printing medium.

16. The table according to claim 15, wherein the correction data table includes information regarding a height of an ink channel of the ink-jet head.

* * * * *